US011503904B2

(12) United States Patent
Giacopelli

(10) Patent No.: US 11,503,904 B2
(45) Date of Patent: Nov. 22, 2022

(54) PORTABLE AND ADJUSTABLE LEG RESTS

(71) Applicant: Michael Giacopelli, Chetham, NJ (US)

(72) Inventor: Michael Giacopelli, Chetham, NJ (US)

( * ) Notice: Subject to any disclaimer, the term of this patent is extended or adjusted under 35 U.S.C. 154(b) by 0 days.

(21) Appl. No.: 17/241,262

(22) Filed: Apr. 27, 2021

(65) Prior Publication Data

US 2022/0338619 A1 Oct. 27, 2022

(51) Int. Cl.
*A47B 13/02* (2006.01)
*A47B 21/02* (2006.01)

(52) U.S. Cl.
CPC ..... *A47B 13/02* (2013.01); *A47B 21/02* (2013.01); *A47B 2200/0097* (2013.01)

(58) Field of Classification Search
CPC ... A47B 2021/0307; A47C 7/52; A47C 7/506; A47C 16/02; A47C 16/025
USPC .... 108/50.14, 50.33, 50.19, 50.12, 50.1, 42; 297/423.39, 423.4, 423.42, 423.44, 297/423.46
See application file for complete search history.

(56) References Cited

U.S. PATENT DOCUMENTS 2,175,488 A * 10/1939 Stoll ..... A47C 16/025 248/370
2,777,506 A 1/1957 Martin
3,554,600 A * 1/1971 Hennessey ..... A47C 16/025 297/461
4,118,087 A * 10/1978 Dorf ..... A47B 45/00 211/105.6
4,195,577 A * 4/1980 Gross ..... A47B 45/00 108/42

(Continued)

FOREIGN PATENT DOCUMENTS

CN 104127032 A 11/2014
CN 110693225 A 1/2020
JP 2013226999 A * 11/2013

OTHER PUBLICATIONS

"W.A.R.D. Airplane Travel Accessories, Memory Foam Foot Hammock, Footrest, Rest. Leg Rest for: Airplane, Train, Bus, Home & Office Accessories" Retrieved from: https://www.amazon.in/Airplane-Travel-Accessories-Hammock-Footrest/dp/B07CXMK46T Retrieved on: Feb. 17, 2021 (5 pages total).

(Continued)

*Primary Examiner* — Jose V Chen
(74) *Attorney, Agent, or Firm* — John Maldjian; Stevens & Lee PC

(57) ABSTRACT

A leg/footrest apparatus includes an adjustable-length axle having a compression rod to force first and second ends of the axle away from one another, and a rest platform that is rotatable about an axis of the axle. The apparatus may include a U-shaped member having first and second ends that extend from the axle and a base portion that extends between the first and second ends coupled to the rest platform. The rest platform may be rotatable about the base portion and may be balanced such that a rest surface of the rest platform remains substantially horizontal as the U-shaped member rotates about the axle. The rest platform may be rotatable between an in-use orientation and a storage orientation. A rotational lock may releasably secure the rest platform in the storage orientation. A foot pedal may be configured to rotate the rest platform between the in-use and storage orientations.

17 Claims, 3 Drawing Sheets

(56) References Cited

U.S. PATENT DOCUMENTS

| | | | | | |
|---|---|---|---|---|---|
| 4,539,977 | A * | 9/1985 | Schneider, Sr. | A61F 5/01 | 606/237 |
| 5,141,286 | A * | 8/1992 | Ayala, Jr. | A47D 15/006 | 297/423.4 |
| 5,207,481 | A * | 5/1993 | Ayala, Jr. | A47D 15/006 | 297/464 |
| 5,623,880 | A * | 4/1997 | Kuntz | A47K 10/38 | 108/50.17 |
| 5,826,941 | A * | 10/1998 | Olsen | A47C 16/02 | 297/423.26 |
| 5,863,282 | A * | 1/1999 | Moossun | A47C 16/02 | 482/904 |
| 6,149,239 | A * | 11/2000 | Markussen | A47C 7/52 | 248/215 |
| 6,511,126 | B1 * | 1/2003 | McAdams | A47C 7/62 | 297/219.1 |
| 6,655,538 | B2 * | 12/2003 | Saulnier-Matteini | A47B 45/00 | 211/175 |
| 6,832,741 | B2 * | 12/2004 | Jarosz | B60N 3/063 | 244/122 R |
| 7,497,812 | B2 | 3/2009 | Neff et al. | | |
| 8,061,278 | B2 | 11/2011 | Skiba | | |
| 9,254,037 | B2 | 2/2016 | Benden | | |
| 9,700,135 | B2 | 7/2017 | Herring et al. | | |
| 9,961,990 | B2 | 5/2018 | Benden | | |
| 10,124,203 | B1 | 11/2018 | Brookshire | | |
| 10,426,260 | B2 | 10/2019 | Benden | | |
| 10,448,732 | B2 | 10/2019 | Asmuth et al. | | |
| 2005/0054492 | A1 | 3/2005 | Neff | | |
| 2008/0303394 | A1 | 12/2008 | Woods et al. | | |
| 2009/0178596 | A1 * | 7/2009 | Skiba | A47B 9/14 | 108/149 |
| 2009/0224591 | A1 * | 9/2009 | Langhorn | A47C 7/52 | 297/423.39 |
| 2014/0020606 | A1 * | 1/2014 | Benden | A47B 13/00 | 108/50.14 |
| 2014/0077569 | A1 * | 3/2014 | Wilson | A63B 21/0053 | 297/423.39 |
| 2019/0150609 | A1 | 5/2019 | Salehi et al. | | |

OTHER PUBLICATIONS

"Travel Bread Airplane Footrest Hammock, Portable Travel Footrest with Inflatable Pillows, Adjustable Height Flight Carry-on Foot Rest Hammock Provides Relaxation & Comfort for Long Flights" Retrieved from: https://www.amazon.com/Travel-Bread-Inflatable-Adjustable-Relaxation/dp/B07K67TDNS/ref=sr_1_1?dchild=1&m=A33RIFRBZKQTG7&qid=1613460039&s=merchant-items&sr=1-1 Retrieved on: Feb. 16, 2021 (11 pages total).

Harita, "Bus Passenger Seats" Retrieved from: https://www.haritaseating.com/PDF/Harita%20Systems%20-%20BUS%20SEATING.pdf Retrieved on: Feb. 16, 2021 (12 pages total).

Changzhou Dobest International Trading Co., Ltd., "Bus Accessories Chair Foot Rest" Retrieved from: https://chinadobest.en.made-in-china.com/product/qXUxbHKTZjcP/China-Bus-Accessories-Chair-Foot-Rest.html Retrieved on: Feb. 17, 2021 (2 pages total).

Leermart, "Adjustable Footrest with Removable Soft Foot Rest Pad" Retrieved from: https://www.amazon.com/Adjustable-Footrest-Removable-Massaging-Adjustment/dp/B07VPCMS6D/ref=pd_lpo_229_t_0/145-0539554-8378429?_encoding=UTF8&pd_rd_i=B07VPCMS6D&pd_rd_r=dec0cf53-999a-4ae8-b26e-bb4cc572a68a&pd_rd_w=XrjeY&pd_rd_wg=GA23L&pf_rd_p=16b28406-aa3 Retrieved on: Feb. 16, 2021.

* cited by examiner

PORTABLE AND ADJUSTABLE LEG RESTS

BACKGROUND

Conventional leg rests are not readily portable and adjustable for different settings (e.g., installations).

SUMMARY

A leg/footrest apparatus includes an adjustable-length axle having a compression rod to force first and second ends of the axle away from one another, and a rest platform that is rotatable about a longitudinal axis of the axle. The apparatus may include a U-shaped member having first and second ends that extend from the axle and a base portion that extends between the first and second ends coupled to the rest platform. The rest platform may be rotatable about the base portion and may be balanced such that a rest surface of the rest platform remains substantially horizontal as the U-shaped member rotates about the axle. The rest platform may be rotatable between an in-use orientation and a storage orientation. A rotational lock may releasably secure the rest platform in the storage orientation. A foot pedal may be configured to rotate the rest platform between the in-use and storage orientations.

BRIEF DESCRIPTION OF THE DRAWINGS/FIGURES

Figure 1:
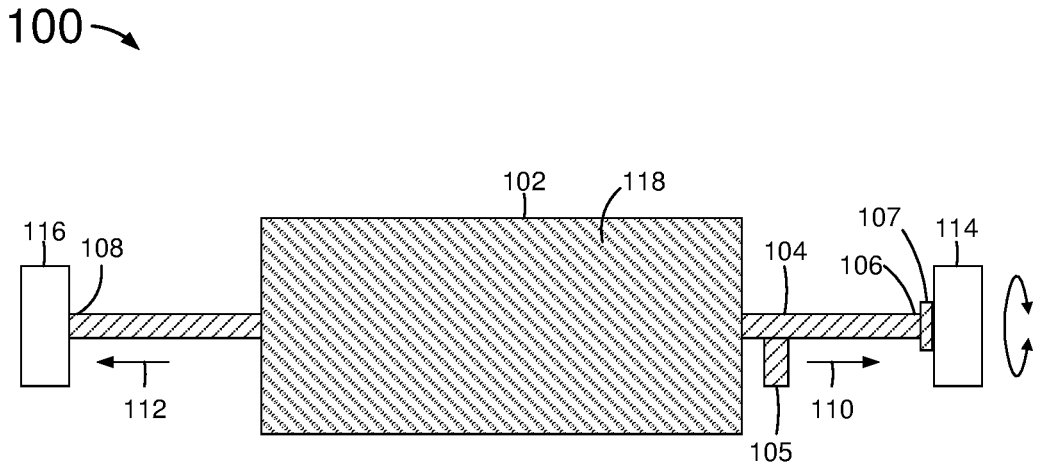
FIG. 1 is a perspective view of a rest apparatus that includes a rest platform that is rotatable about a longitudinal axis of an adjustable length axle.

In the drawings, the leftmost digit(s) of a reference number identifies the drawing in which the reference number first appears.

DETAILED DESCRIPTION

Disclosed herein are portable and configurable rest apparatuses on which to rest legs and/ or feet.

FIG. 1 is a perspective view of a rest apparatus 100 that includes a rest platform 102 that is rotatable about a longitudinal axis of an adjustable length axle (axle) 104. Rest apparatus 100 may be useful as a leg rest and/or a footrest. Rest apparatus 100 may be installed between opposing walls or legs of a piece of furniture (e.g., a desk), without alteration of the piece of furniture, an example of which is described below with reference to FIG. 2.

Figure 2:
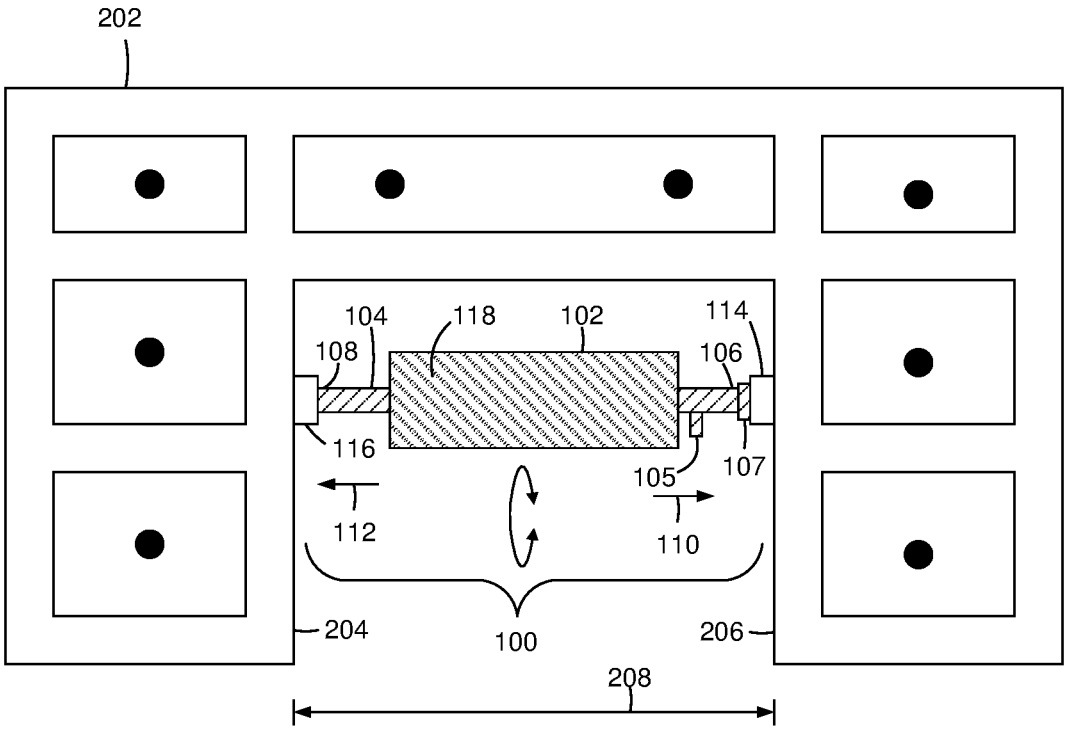
FIG. 2 is a perspective view of the rest apparatus, positioned between opposing walls of a desk.

FIG. 2 is a perspective view of rest apparatus 100 positioned between opposing walls 204 and 206 of a desk 202.

Axle 104 may be configured as or may include a compression rod configured to force first and second ends 106 and 108 away from one another, in directions of arrows 110 and 112. Axle 104 may include, for example, a spring that is compressible by rotating ends 106 and 108 relative to one another. In this example, a length of axle 104 may also be adjusted by rotating ends 106 and 108 relative to one another. Alternatively, or additionally, axle 104 may include a sealed or sealable gas chamber.

In the examples above, a length of axle 104 may be adjusted to a length that is slightly greater than a width 208 between opposing walls 204 and 206. Ends 106 and 108 may then be pressed slightly towards one another (i.e., in directions opposite of directions 110 and 112), positioned between walls 204 and 206, and released. Upon release, the compression rod of axle 104 will slightly expand the length of axle 104 to press ends 106 and 108 against walls 204 and 206, and thereby maintain a position of axle 104.

Rest apparatus 100 may further include first and second end pads 114 and 116, each coupled to respective ends 106 and 108 of axle 104. End pads 114 and 116 may be configured to protect surfaces of walls 204 and 206 from scratches and/ or other damage from axle 104.

Rest platform 102 may be fully rotational about the longitudinal axis of axle 104 (i.e., 360 degrees). Alternatively, rest platform 104 may be rotatable between a first orientation and a second orientation. The first orientation may correspond to an in-use position. The second orientation may correspond to an out-of-the way or storage position.

Figure 3:
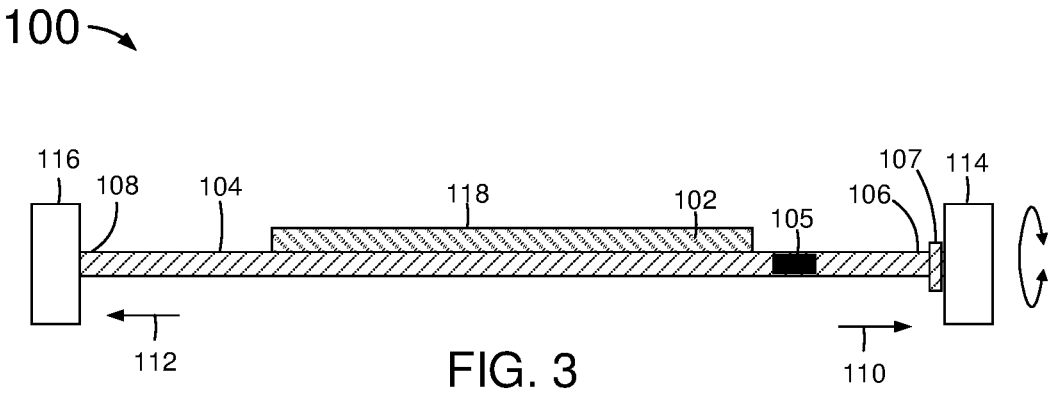
FIG. 3 is another perspective view of the rest apparatus.

FIG. 3 is another perspective view of rest apparatus 100, in which rest surface 118 of rest platform 102 is substantially horizontal and may be free to rotate slightly or within a range. This may correspond to the first orientation described above. In this position, a person sitting at desk 202 may extend their legs over rest apparatus 100 and relax their legs such that their calves are in contact with rest surface 118.

In the second orientation, rest surface 118 may be substantially vertical as illustrated in FIGS. 1 and 2. Rest apparatus may further include a rotational lock to releasably secure rest platform in the second orientation.

In the examples of FIGS. 1-3, rest platform 102 is in contact with axle 104. Rest platform 102 may be connected to axle 104 in a variety of ways, examples of which are provided below with reference to FIGS. 4 and 5.

Figure 4:
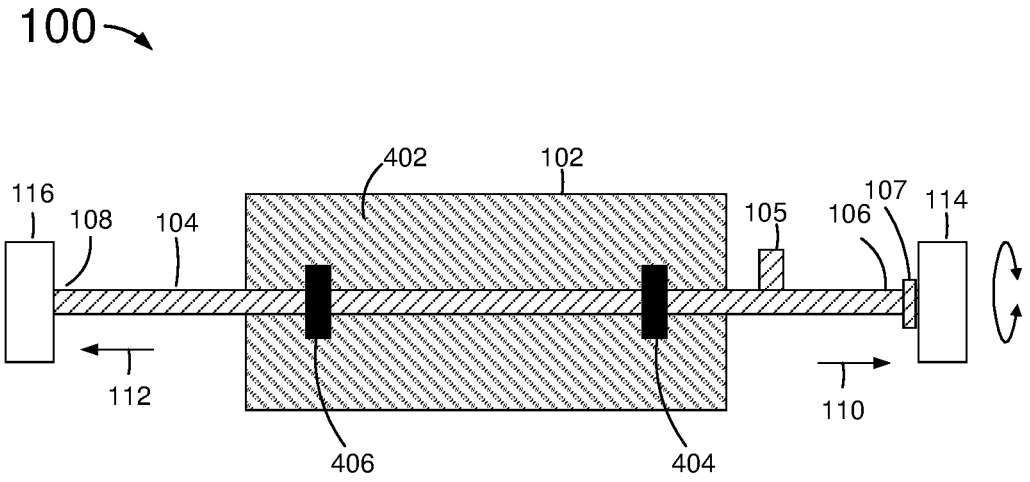
FIG. 4 is another perspective view of the rest apparatus.
Figure 5:
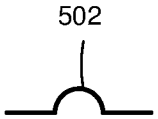
FIG. 5 is a perspective view of a U-type connector.

FIG. 4 is a perspective view of rest apparatus 100, directed to an underside 402 of rest platform 102. Underside 402 is opposite rest surface 118. In this example, rest apparatus 100 further includes connectors 404 and 406 to couple rest platform 102 to axle 104. Connectors 404 and 406 may include U-type connectors, such as a U-type connector 502 illustrated in FIG. 5. Connectors 404 and 406 are not, however, limited to U-type connectors.

In an embodiment, rest platform 102 and axle 104 are integral with one another. In this example, first end 106 of axle 104 extends from a first side of rest platform 102, and second end 108 of axle 104 extends from a second side of rest platform 102, opposite the first side.

Rest platform 102 may be configured to rotate about axle 104, and axle 104 may be stationary relative to end pads 114 and 116. Alternatively, or additionally, axle 104 may be configured to rotate relative to end pads 114 and 116.

In an embodiment, a rest apparatus includes a U-shaped extension, which may be useful to provide a greater range of motion to a rest platform. Examples are described below with reference to FIGS. 6, 7, and 8.

Figure 6:
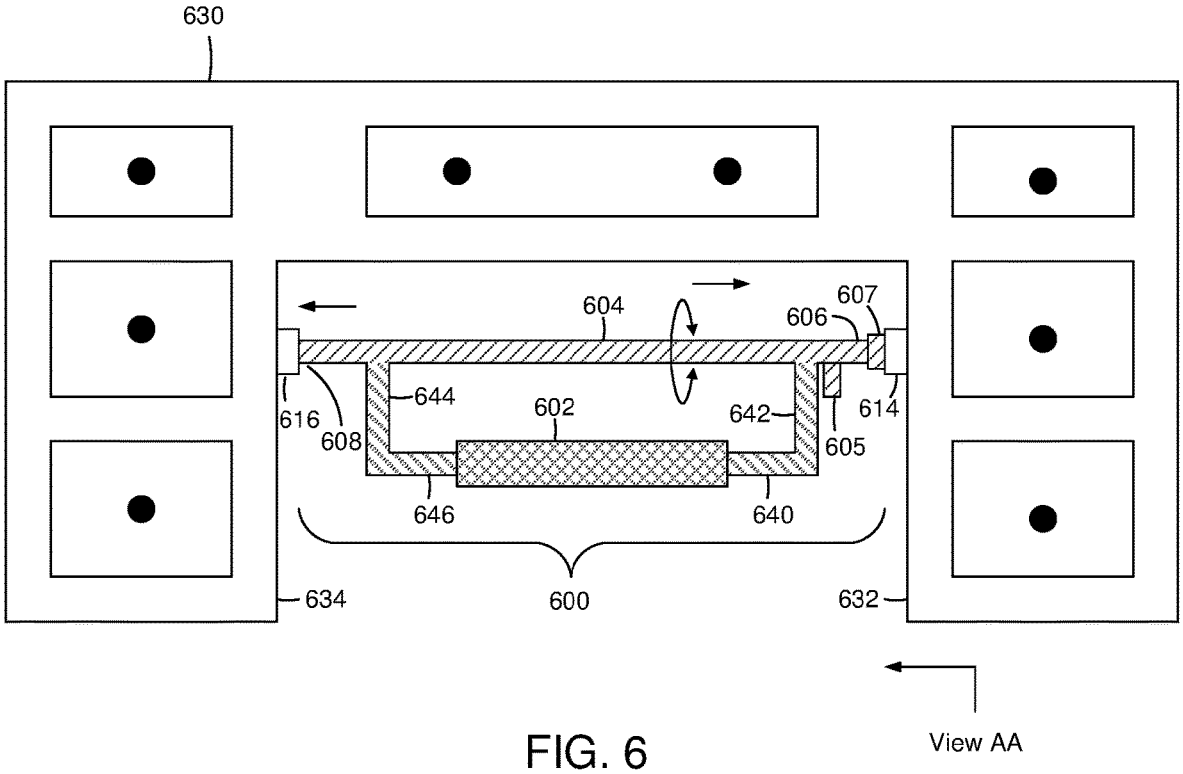
FIG. 6 is a perspective view of another embodiment of a rest apparatus.

FIG. 6 is a perspective view of a rest apparatus 600 positioned between opposing walls 632 and 634 of a desk 630. Rest apparatus 600 includes a rest platform 602, an adjustable length axle (axle) 604, and a U-shaped member 640. U-shaped member 620 includes first and second ends 642 and 644 extending from axle 604, and a base portion 646. Rest platform 602 is coupled to base portion 640.

Axle 604 may be configured as described above with respect to axle 104.

U-shaped member 640 is rotatable about a longitudinal axis of axle 604. In an embodiment, axle 604 does not rotate relative to desk 630, and U-shaped member 640 rotates about axle 604. In another embodiment, U-shaped member 640 and axle 604 are fixedly coupled to one another, and U-shaped member 640 and axle 604 rotate about the axis of axle 604.

U-shaped member 640 may be rotatable between first and second orientations, examples of which are provided below with reference to FIGS. 7 and 8.

Figure 7:
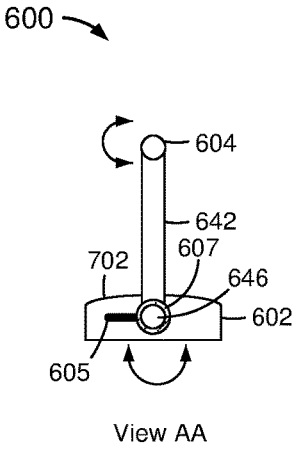
FIG. 7 is a side-view of the rest apparatus of FIG. 6 in a first orientation.

FIG. 7 is a side-view of rest apparatus 600 in which U-shaped member 640 is positioned in a first orientation. In this example, first end 642 is oriented substantially vertically. This orientation may be referred to as an in-use orientation. U-shaped member 640 may freely rotate when in the first orientation.

Figure 8:
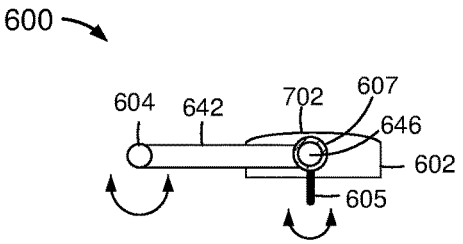
FIG. 8 is another side-view of the rest apparatus of FIG. 6 in a second orientation.

FIG. 8 is a side-view of rest apparatus 600 in which U-shaped member 640 is positioned in a second orientation. In this example, first end 642 is oriented substantially horizontally. This orientation may be referred to as an out-of-the way or storage orientation.

As illustrated FIGS. 7 and 8, rest platform 602 may be rotatable about base portion 646 of U-shaped member 640. Rest platform 602 may also be balanced such that a rest surface 702 of rest platform 602 remains substantially horizontal as U-shaped member 640 rotates about axle 604.

Rest platform 602 may be connected to base portion 646 in a variety of ways. As an example, and without limitation, base portion 646 may include a rod that extends between first and second ends 642 and 644 of U-shaped member 640, and through rest platform 602. Rest platform 602 and/or base portion 646 may include ball bearings to provide for smooth rotation of rest platform 602 about base portion 646. In another embodiment, rest platform 602 may be connected to base portion 646 with relatively loose-fitting U-type connectors. A rest apparatus is not, however, limited to these examples.

In FIG. 6, rest apparatus 600 further includes first and second end pads 614 and 616, each coupled to respective ends 606 and 608 of axle 604. End pads 614 and 616 may be configured to protect surfaces of walls 632 and 634 from scratches and/ or other damage from axle 604.

A U-shaped member, such as described above, may provide a greater range of motion to a rest platform. The greater range of motion may be useful to re-orient rest platform to an out-of-the way orientation.

A rest apparatus as disclosed herein may include a foot pedal to rotate a rest platform. The foot pedal may extend from an axle (e.g., axle 104 in FIG. 1 or axle 604 in FIG. 6) and may be configured to rotate the rest platform between first and second orientations in response to a physical force applied to the foot pedal. The foot pedal may extend several inches from the axle.

A rest apparatus as disclosed herein may include a rotational lock to releasably secure a rest platform in one or more orientations. Where the rest apparatus includes a foot pedal to rotate a rest platform, the foot pedal may be further configured to engage and disengage the lock. For example, and without limitation, the foot pedal may be configured to rotate the rest platform from a first orientation to a second orientation and engage the lock in response to a first physical force applied to the foot pedal. The foot pedal may be further configured to release the lock in response to a second physical force applied to the foot pedal subsequent to application of the first physical force. The rest platform is configured to return to the first orientation when the lock is released, by gravity and/ or other mechanism.

A rest apparatus as disclosed herein may include a ratchet mechanism operable by a foot pedal to rotate a rest platform in response to a force applied to the foot pedal.

A rest apparatus as disclosed herein may include multiple foot pedals extending from the axle. For example, and without limitation, a first foot pedal may extend from the axle to rotate a rest platform from a first orientation to a second orientation in response to a physical force applied to the first foot pedal. A second foot pedal may extend from the axle, perpendicular to the first foot pedal, to rotate the rest platform from the second orientation to the first orientation in response to a physical force applied to the second foot pedal.

A rest apparatus as disclosed herein may include a cushion attached to a surface of a rest platform.

In FIGS. 1-4, rest apparatus 100 includes a foot pedal 105 and a rotational brake 107.

In FIGS. 6-7, rest apparatus 600 includes a foot pedal 605 and a rotational brake 607.

Apparatuses are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein.

What is claimed is:

1. An apparatus, comprising:

an adjustable length axle that comprises a compression rod configured to force first and second ends of the axle away from one another; and a rest platform, rotatable about an axis of the axle between a first orientation and a second orientation, wherein the axle includes a rotational lock to releasably secure the rest platform in the second orientation; and a foot pedal configured to rotate the rest platform between the first orientation and the second orientation in response to a physical force applied to the foot pedal.

2. The apparatus of claim 1, further comprising:

a U-shaped member comprising first and second ends that extend from the axle and a base portion that extends between the first and second ends;

wherein the rest platform is coupled to the base portion.

3. The apparatus of claim 2, wherein the U-shaped member is rotatable about an axis of the axle.

4. The apparatus of claim 3, wherein the U-shaped member is rotatable about the axis of the axle, between first and second orientations.

5. The apparatus of claim 4, wherein:

the first and second ends of the base portion are oriented vertically when the U-shaped member is in the first orientation; and the first and second ends of the base portion are oriented horizontally when the U-shaped member is in the second orientation.

6. The apparatus of claim 3, wherein:

the rest platform is rotatable about the base portion of the U-shaped member.

7. The apparatus of claim 6, wherein:

the rest platform is balanced such that a rest surface of the rest platform remains substantially horizontal as the U-shaped member rotates about the axle.

8. The apparatus of claim 1, wherein the rest platform is attached to the axle.

9. The apparatus of claim 1, wherein a first portion of the axle extends from a first side of the rest platform and a second portion of the axle extends from a second side of the rest platform, wherein the first and second sides are opposite one another.

10. The apparatus of claim 1, wherein the foot pedal is configured to engage and disengage the rotational lock.

11. The apparatus of claim 10, wherein:

the foot pedal is configured to rotate the rest platform from the first orientation to the second orientation and engage the lock in response to a first physical force applied to the foot pedal; and the foot pedal is further configured to release the lock in response to a second physical force applied to the foot pedal subsequent to the first physical force;

wherein the rest platform is configured to return to the first orientation when the lock is released.

12. The apparatus of claim 1, further comprising:

a first foot pedal extending from the axle to rotate the rest platform from a first orientation to a second orientation in response to a physical force applied to the first foot pedal; and a second foot pedal extending from the axle, perpendicular to the first foot pedal, to rotate the rest platform from the second orientation to the first orientation in response to a physical force applied to the second foot pedal.

13. The apparatus of claim 1, further comprising:

first and second end pads, each coupled to a respective one of the first and second ends of the axle.

14. The apparatus of claim 13, wherein the first and second end pads are configured to protect inner surfaces of a piece of furniture from the axle.

15. The apparatus of claim 13, wherein the axle is configured to rotate relative to the first and second end pads.

16. The apparatus of claim 13, wherein the axle is non-rotational relative to the first and second end pads.

17. The apparatus of claim 1, further comprising:

a cushioned rest pad attached to a surface of the rest platform.

* * * * *